US007264917B2

(12) United States Patent
Hu et al.

(10) Patent No.: US 7,264,917 B2
(45) Date of Patent: Sep. 4, 2007

(54) FLUID INJECTION MICRO DEVICE AND FABRICATION METHOD THEREOF

(75) Inventors: Hung-Sheng Hu, Kaohsiung (TW); Wei-Lin Chen, Taipei (TW); Tsung-Ping Hsu, Jungli (TW)

(73) Assignee: BenQ Corporation, Taoyuan (TW)

( * ) Notice: Subject to any disclaimer, the term of this patent is extended or adjusted under 35 U.S.C. 154(b) by 629 days.

(21) Appl. No.: 10/877,459

(22) Filed: Jun. 25, 2004

(65) Prior Publication Data

US 2005/0001884 A1 Jan. 6, 2005

(30) Foreign Application Priority Data

Jun. 27, 2003 (TW) ..... 92117543 A

(51) Int. Cl.
*B41J 2/16* (2006.01)

(52) U.S. Cl. ..... 430/321; 216/27

(58) Field of Classification Search ..... None
See application file for complete search history.

(56) References Cited

U.S. PATENT DOCUMENTS 6,102,530 A 8/2000 Kim et al.
6,126,846 A * 10/2000 Silverbrook ..... 216/27
6,158,846 A * 12/2000 Kawamura ..... 347/65
2004/0130597 A1* 7/2004 Kim et al. ..... 347/56

FOREIGN PATENT DOCUMENTS

CN 1245753 A 3/2000
CN 1290211 A 4/2001
CN 1504334 A 6/2004
JP 2002-113870 4/2002

* cited by examiner

*Primary Examiner*—John A. McPherson
(74) *Attorney, Agent, or Firm*—Quintero Law Office

(57) ABSTRACT

A method for fabricating a fluid injection micro device. The method includes the steps of providing a substrate with an insulating layer thereon. A heater is formed on the insulating layer. A patterned conductive layer is formed on the heater and the insulating layer. A protective layer is formed on the conductive layer to insulate the conductive layer. An opening is formed by sequentially etching the protective layer, the insulating layer and the substrate. A patterned thick film, having a defined chamber, is formed on the protective layer. The back of the substrate is removed and thinned until the opening forms a through hole.

19 Claims, 5 Drawing Sheets

FLUID INJECTION MICRO DEVICE AND FABRICATION METHOD THEREOF

BACKGROUND OF THE INVENTION

1. Field of the Invention

The present invention relates to a fabrication method for a fluid injection micro device, and more particularly, to deep silicon etching and polishing method for a fluid injection micro device.

2. Description of the Related Art

An ink-jet printhead is a key component of a color ink-jet printer. The Ink-jet printhead comprises an upper plate, an intermediate dry film, and a lower plate. The upper layer comprising an ink nozzle may be composed of noble metal (e.g., Cu, Au, Ni, or Ni—Au alloy), glass, or plastic. The lower plate is a thermally stable substrate, such as a silicon wafer, having microelectronic circuits thereon. The intermediate dry film is lithographed and etched to define an ink passageway.

FIG. 1 is a schematic diagram of a conventional fluid injection micro device. Referring to FIG. 1, a fluid injection micro device is formed on a substrate 10 (e.g., silicon wafer). A dielectric layer 20, such as silicon oxide, is formed on the substrate 10. The dielectric layer 20 may be deposited using a CVD process. A patterned resistive layer 30 is formed on the dielectric layer 20 as a heater. The resistive layer 30 comprises $HfB_2$, TaAl, TaN, or TiN. The resistive layer 30 may be deposited using a PVD process, such as evaporation, sputtering, or reactive sputtering. Next, a patterned conductive layer 40, such as Al, Cu, or Al—Cu alloy, is formed overlying the dielectric layer 20 and covers the heater 30 to form a signal transmitting circuit. The conductive layer 162 may be deposited using a PVD process, such as evaporation, sputtering, or reactive sputtering. Thereafter, a protective layer 50 is formed using a CVD process to isolate the ink and the heater.

Thereafter, a thick film 60 is formed on the protective layer 50. The thick film 60 is composed of polymer material, such as polyimide, is formed around a fluid chamber 70 containing ink. After formation of a manifold and attachment of a plate 80, the substrate is bonded onto a flexible printed circuit board. The nozzle plate 80 comprises an electroplating plate or a flexible printed circuit board. According to this conventional method, the heating element 30 is beneath the orifice 90. The inkjet droplet is ejected from the fluid chamber 70 by pullback force. It is difficult to inhibit unstable ink conditions which result in satellite droplets. For example, ink close to the orifice can overflow, or the tail of an ink droplet may not be cut off properly. The tiny ink droplets that trail the main droplets, known as satellite droplets, may hit the paper at locations slightly different than the main droplets and blur the printed image. Moreover, in order to accurately align the heating element 30 and the orifice 90, either the electroplating plate or a flexible printed circuit board is required, thus, manufacturing costs are increased.

U.S. Pat. No. 6,102,530 discloses a method of a fluid injection micro device using a wet etching process. Referring to FIG. 2, a fluid injection micro device comprises discharge resistors, such as the first heater 130*a* and second heater 130*b*, placed on opposing sides of the orifice 132 possess different resistances and are electrically connected to a common electrode (not shown) for activating the ink in the associated chamber 170.

After a common electrical pulse is applied, the first heater 130*a* and second heater 130*b* are activated simultaneously.

Due to the resistance difference, the first heater 130*a*, having a narrower cross-section, is activated more quickly and generates a first bubble 180*a*. The expanding first bubble 180*a* begins to restrict the ink flow to the manifold 160, and finally functions as a virtual valve to isolate the chamber 170 and to prevent the adjacent chambers from cross talk. Then, a second bubble 180*b* is formed by the second heater 130*b*. As the second bubble 180*b* expands and approaches the first bubble 180*a*, the ink is pressurized by the first bubble 180*a* and the second bubble 180*b* and is ejected through the orifice 132. However, it is critical to control the construction of the support layer, in order to meet high production yield and durability requirements.

SUMMARY OF THE INVENTION

An object of the present invention is to provide a fabrication method for a fluid injection micro device. Using deep silicon etching and polishing processes, an orifice is formed in a silicon substrate, thereby providing improved orifice accuracy, reducing droplet diameter, minimizing cross talk and its related effects, and increasing the resolution of the print image.

According the object mentioned above, the present invention provides a method for fabricating a fluid injection micro device. A substrate is provided. At least one heater is formed on the substrate. A patterned conductive layer is formed overlying the heater and the substrate. A protective layer is formed overlying the conductive layer and the substrate to insulate the conductive layer. The protective layer and the substrate are sequentially etched to form an opening. A patterned thick film is formed on the protective layer, wherein defining a fluid chamber. The bottom of the substrate is removed until the opening coming through the substrate as a nozzle.

According the object mentioned above, the present invention provides another method for fabricating a fluid injection micro device. A substrate is provided. At least one heater is formed on the substrate. A patterned conductive layer is formed overlying the heater and the substrate. A protective layer is formed overlying the conductive layer and the substrate to insulate the conductive layer. The bottom of the substrate is removed and thinned. The protective layer and the substrate are sequentially etched to form an opening through the substrate. A patterned thick film is formed on the protective layer, thereby defining a fluid chamber.

In the present invention, the thick film includes a photosensitive polymer. The photosensitive polymer is preferably epoxy resin, glycidyl methacrylate, acrylic resin, acrylate or methacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, or polyoxadiazole.

The invention also provides a fluid injection micro device. At least one heater is formed on the substrate. A patterned conductive layer is formed overlying the heater and the substrate. A protective layer is formed overlying the conductive layer and the substrate to insulate the conductive layer. A patterned thick film is formed on the protective layer, thereby defining a fluid chamber. A nozzle is located within the substrate as a micro fluid ejecting nozzle.

The present invention improves on the prior art in that the nozzle is formed directly into the silicon substrate using a deep silicon etching and polishing process, thereby providing improved orifice accuracy, reducing droplet diameter, minimizing cross talk and its related effects, and increasing the resolution of the print image.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

First Embodiment

Figure 1:
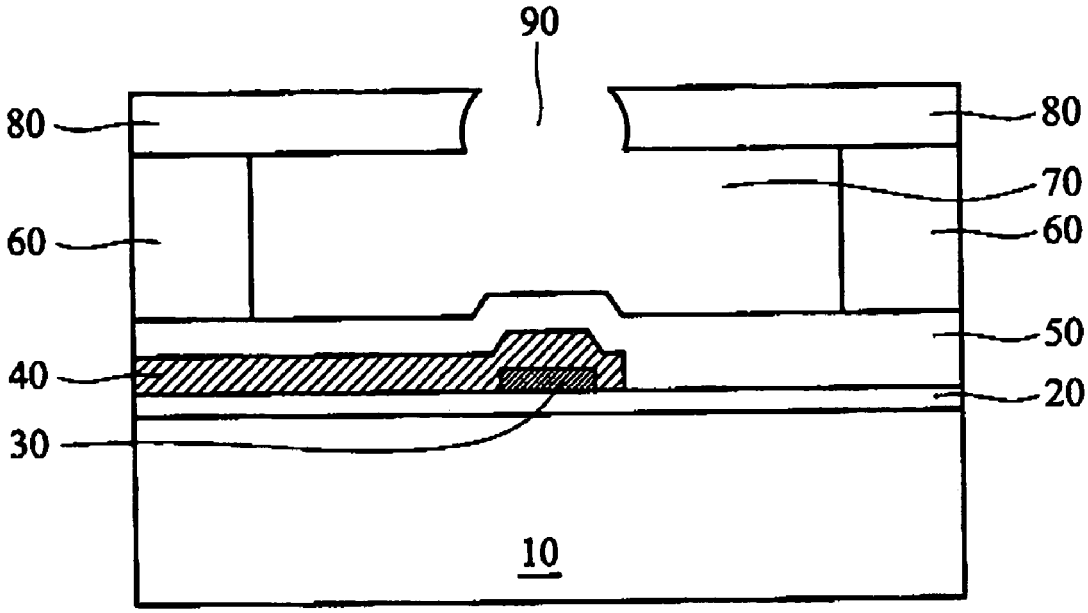
FIG. 1 ( PRIOR ART )
FIG. 1 is a schematic diagram of a conventional fluid injection micro device.
Figure 2:
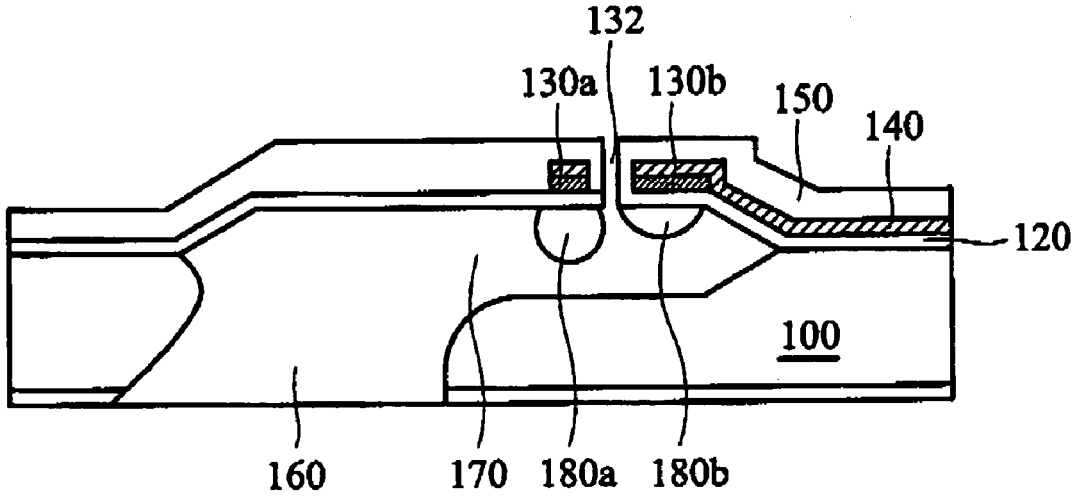
FIG. 2 ( PRIOR ART )
FIG. 2 shows a cross-section of another known conventional fluid injection micro device.
Figure 3A:
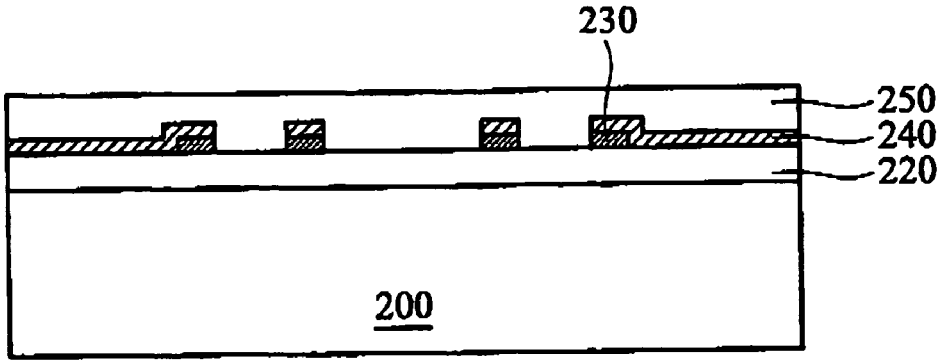
FIGS. 3A to 3C are cross-sections illustrating the steps of manufacturing a fluid injection micro device according to the first embodiment of the present invention.
Figure 3B:
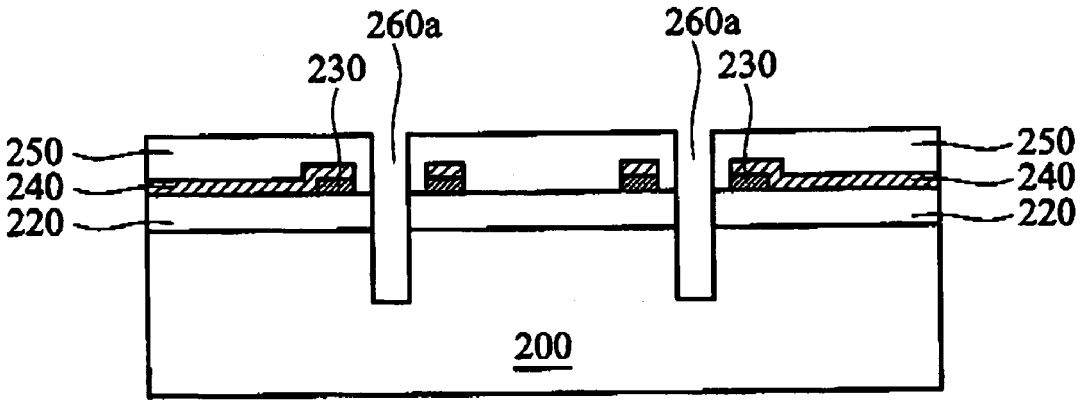
Figure 3C:
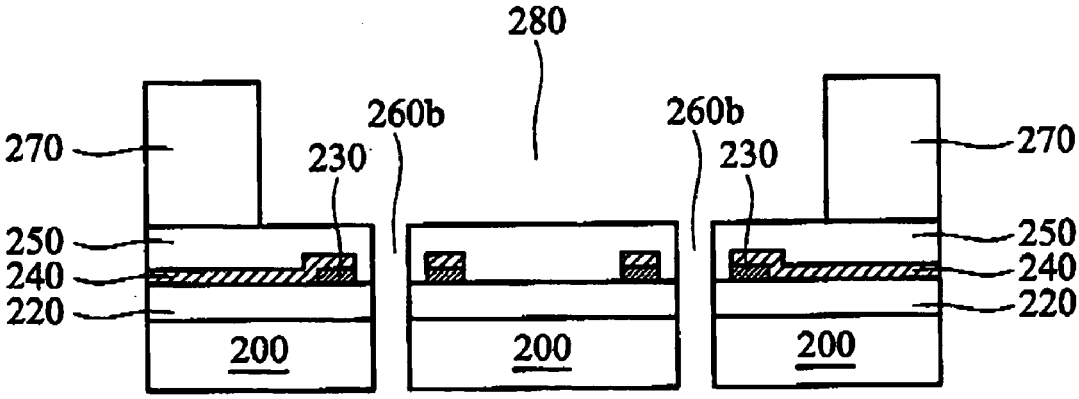

FIGS. 3A to 3C are cross-sections illustrating the steps of manufacturing a fluid injection micro device according to the first embodiment of the present invention. Referring to FIG. 3A, a dielectric layer 220 is formed on a substrate 200 (e.g., a silicon wafer). The sacrificial layer 220 comprises silicon oxide with a thickness between about 1500 Å to 2000 Å. The dielectric layer 220 may be deposited using a CVD or LPCVD process. A patterned resistive layer 230 is then formed on the dielectric layer 220 to serve as a heater. The resistive layer 230 comprises $HfB_2$, TaAl, TaN, or TiN. The resistive layer 230 may be deposited using a PVD process, such as evaporation, sputtering, or reactive sputtering. A patterned conductive layer 240, such as Al, Cu, or Al—Cu alloy, is subsequently formed overlying the dielectric layer 220 and covers the resistive layer 230 to act as a signal transmitting circuit. The conductive layer 240 may be deposited using a PVD process, such as evaporation, sputtering, or reactive sputtering. A protective layer 250 is formed overlying the substrate 100 to insulate the ink and the heater 230. The protective layer 250 is composed of silicon oxide, silicon nitride, silicon carbide, or a stack of thin film layers. A metal layer (not shown) is deposited on the protective layer 250. The metal layer prevents potential damage due to the impact of a collapsing bubble against the protective layer 250.

Referring to FIG. 3B, a lithography process is performed to define a predetermined orifice site (not shown) in the substrate. The protective layer 250, the conductive layer 240, and silicon substrate 200 are etched sequentially using deep silicon etching technology, such as plasma etching, wet etching, chemical dry etching, reactive ion etching, or laser etching to form an opening 260*a* at the predetermined orifice site.

Thereafter, a thick film 270 is formed on the protective layer 250 and suspended over the opening 260*a*. The thick film 270 is composed of a photosensitive polymer. Preferably the photosensitive polymer is epoxy resin, glycidyl methacrylate, acrylic resin, acrylate or methacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, or polyoxadiazole.

Next, a fluid chamber 280 is formed by pattering the thick film 270 and exposes the opening 260*a*. The bottom of the substrate 200 is removed and thinned using etching, polishing, or chemical mechanical polishing (CMP) The substrate 200 is thinned until the opening 260*a* becomes a through-hole 260*b*. The through-hole 260*b* is the nozzle of the fluid injection micro device.

Second Embodiment

Figure 4A:
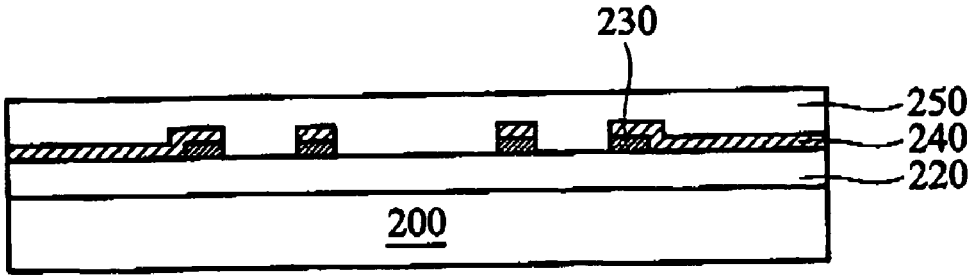
FIGS. 4A to 4C are cross-sections illustrating the steps of manufacturing a fluid injection micro device according to the second embodiment of the invention.
Figure 4B:
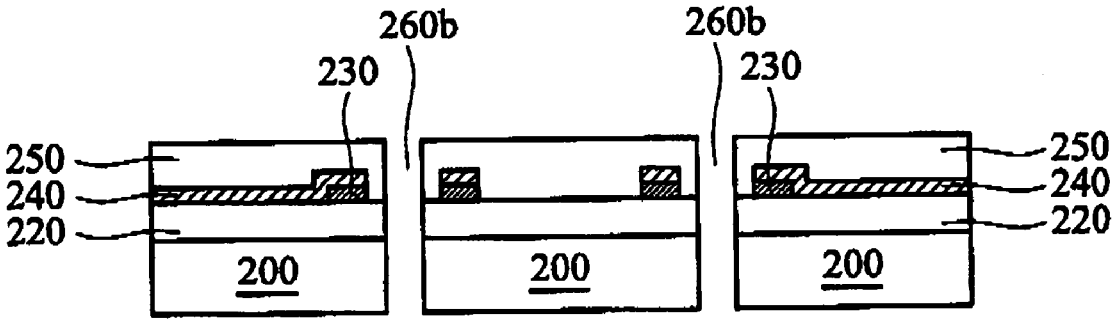
Figure 4C:
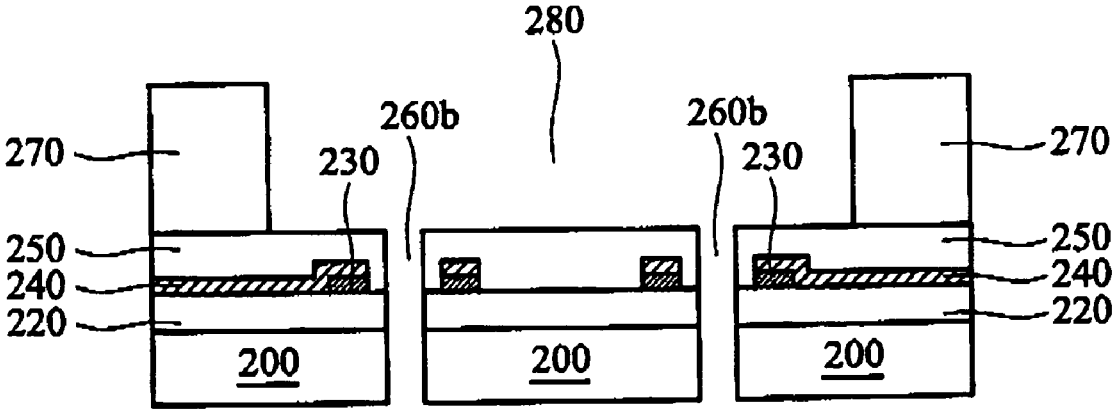

FIGS. 4A to 4C are cross-sections illustrating the steps of manufacturing a fluid injection micro device according to the second embodiment of the invention. Referring to FIG. 4A, a dielectric layer 220 is formed on a substrate 200 (e.g. a silicon wafer). The sacrificial layer 220 includes silicon oxide with a thickness between about 1500 Å to 2000 Å. The dielectric layer 220 may be deposited using a CVD or a LPCVD process. A patterned resistive layer 230 is then formed on the dielectric layer 220 as a heater. The resistive layer 230 comprises $HfB_2$, TaAl, TaN, or TiN. The resistive layer 230 may be deposited using a PVD process, such as evaporation, sputtering, or reactive sputtering. A patterned conductive layer 240, such as Al, Cu, or Al—Cu alloy, is subsequently formed overlying the dielectric layer 220 and covers the resistive layer 230 as a signal transmitting circuit. The conductive layer 240 may be deposited using a PVD process, such as evaporation, sputtering, or reactive sputtering. A protective layer 250 is formed overlying the substrate 100 to insulate the ink and the heater 230. The protective layer 250 is composed of silicon oxide, silicon nitride, silicon carbide, or a stack of thin film layers. A metal layer (not shown) is deposited on the protective layer 250. The metal layer prevents potential damage due to impact by a bubble collapsing against the protective layer 250. The bottom of the substrate 200 is removed and thinned using etching, polishing, or chemical mechanical polishing (CMP).

Referring to FIG. 4B, a lithography process is performed to define a predetermined orifice site (not shown) in the substrate. The protective layer 250, the conductive layer 240, and silicon substrate 200 are etched sequentially using deep silicon etching technology, such as plasma etching, wet etching, chemical dry etching, reactive ion etching, or laser etching to form a through-hole 260*b* at the predetermined orifice site. The through-hole 260*b* is the nozzle of the fluid injection micro device.

Referring to FIG. 4C, a thick film 270 is formed on the protective layer 250 and suspended over the opening 260*a*. The thick film 270 is preferably composed of a photosensitive polymer, particularly epoxy resin, glycidyl methacrylate, acrylic resin, acrylate or methacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, or polyoxadiazole.

Next, a fluid chamber 280 is formed by pattering the thick film 270 to expose the through hole 260*b*.

Third Embodiment

Figure 5A:
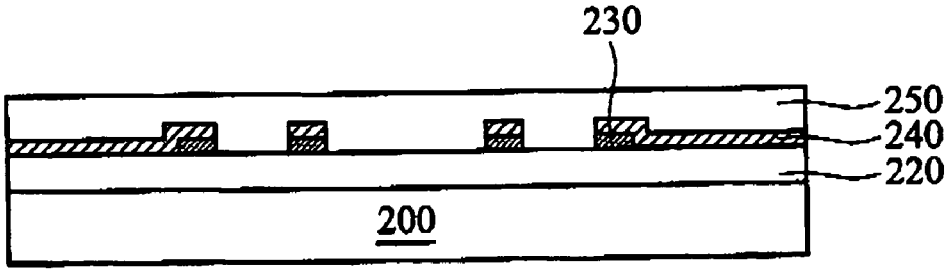
FIGS. 5A to 5C are cross-sections illustrating the steps of manufacturing a fluid injection micro device according to the third embodiment of the invention.
Figure 5B:
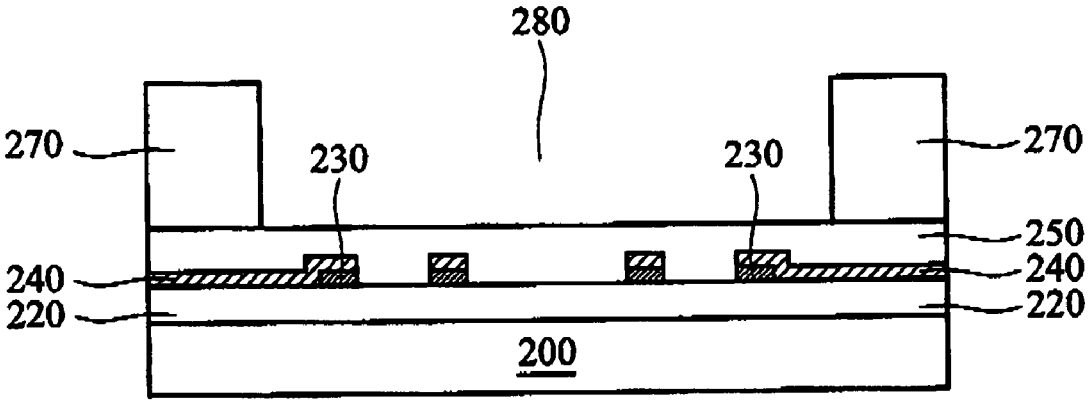
Figure 5C:
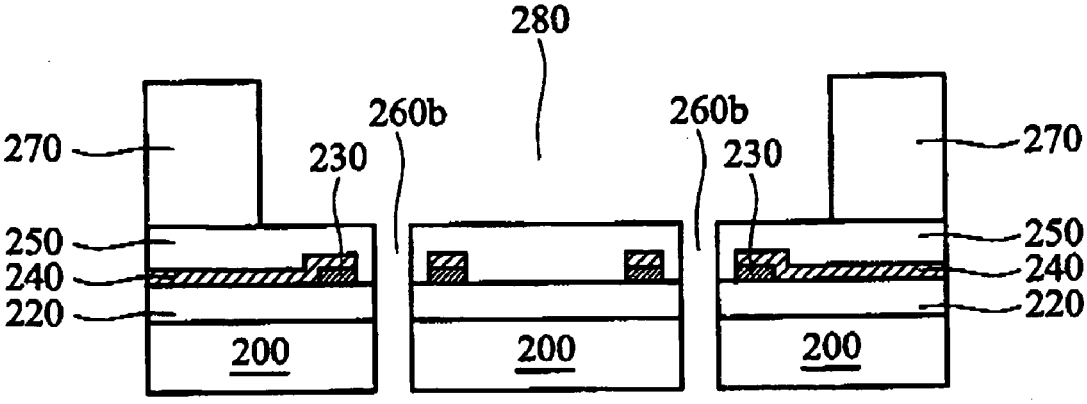

FIGS. 5A to 5C are cross-sections illustrating the steps of manufacturing a fluid injection micro device according to the third embodiment of the invention. Referring to FIG. 5A, a dielectric layer 220 is formed on a substrate 200 (e.g., a silicon wafer). The sacrificial layer 220 includes silicon oxide with a thickness between about 1500 Å to 2000 Å. The dielectric layer 220 may be deposited using a CVD or LPCVD process. Then, a patterned resistive layer 230 is formed on the dielectric layer 220 as a heater. The resistive layer 230 comprises $HfB_2$, TaAl, TaN, or TiN. The resistive layer 230 may be deposited using a PVD process, such as evaporation, sputtering, or reactive sputtering. A patterned conductive layer 240, such as Al, Cu, or Al—Cu alloy, is subsequently formed overlying the dielectric layer 220 and covers the resistive layer 230 as a signal transmitting circuit. The conductive layer 240 may be deposited using a PVD process, such as evaporation, sputtering, or reactive sputtering. A protective layer 250 is formed overlying the substrate 100 to insulate the ink and the heater 230. The protective layer 250 is composed of silicon oxide, silicon nitride, silicon carbide, or a stack of thin film layers. A metal layer (not shown) is deposited on the protective layer 250. The metal layer prevents potential damage due to impact by a bubble collapsing against the protective layer 250. The bottom of the substrate 200 is removed and thinned using etching, polishing, or chemical mechanical polishing (CMP).

Referring to FIG. 5B, a thick film 270 is formed on the protective layer 250 and suspended over the opening 260*a*. The thick film 270 is preferably composed of a photosensitive polymer. It is particularly preferable that the photosensitive polymer is epoxy resin, glycidyl methacrylate, acrylic resin, acrylate, or methacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, or polyoxadiazole. Next, a fluid chamber 280 is formed by pattering the thick film 270 to expose the opening 260*a*.

Referring to FIG. 5B, a lithography process is performed to define a predetermined orifice site (not shown) in the substrate. The protective layer 250, the conductive layer 240, and silicon substrate 200 are etched sequentially using deep silicon etching technology, such as plasma etching, wet etching, chemical dry etching, reactive ion etching, or laser etching to form a through-hole 260*b* at the predetermined orifice site. The through-hole 260*b* is the nozzle of the fluid injection micro device.

Figure 6:
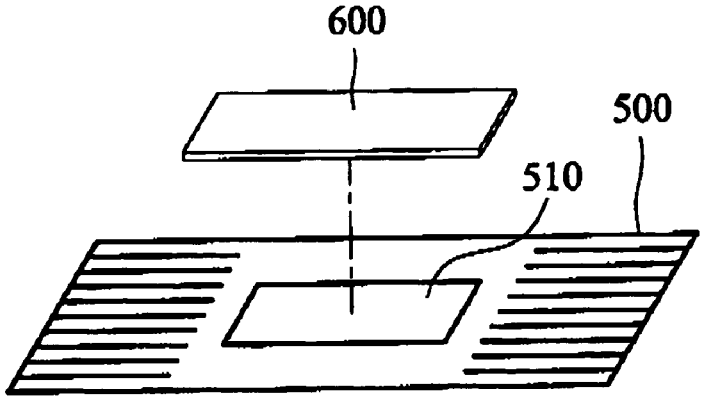
FIG. 6 shows an arrangement diagram of the die placement and the bonding process of the chip onto the flexible circuit board.

FIG. 6 is a diagram showing the arrangement of the die placement and the process of bonding the chip onto the flexible circuit board. Referring to FIG. 6, after cutting the completed substrate 200, and completing the manifold formation, and plate 500 attachment processes the fluid injection micro device is complete. The plate 500 comprises an electroplated plate or a flexible circuit board.

The step of nozzle plate 500 attach process further comprises a tape carrier package (TCP) or a chip on film (COF) package. A cutting of the chip 600 from the completed substrate 200 is cut and then hot pressed onto the flexible circuit board 500. The chip 600 may also be attached to the flexible circuit board 500 using anisotropic conductive paste (ACP).

Preceding the nozzle plate 500 attachment process steps, an opening 510 is formed in the flexible circuit board 500 using a punching or an etching process. The surfaces of the dry film 270 and the flexible circuit board 500 are then bonded by heating the anisotropic conductive paste (ACP). The opening 510 of the flexible circuit board 500 is the manifold 510 for fluid flowing into the fluid chamber 280.

Figure 7:
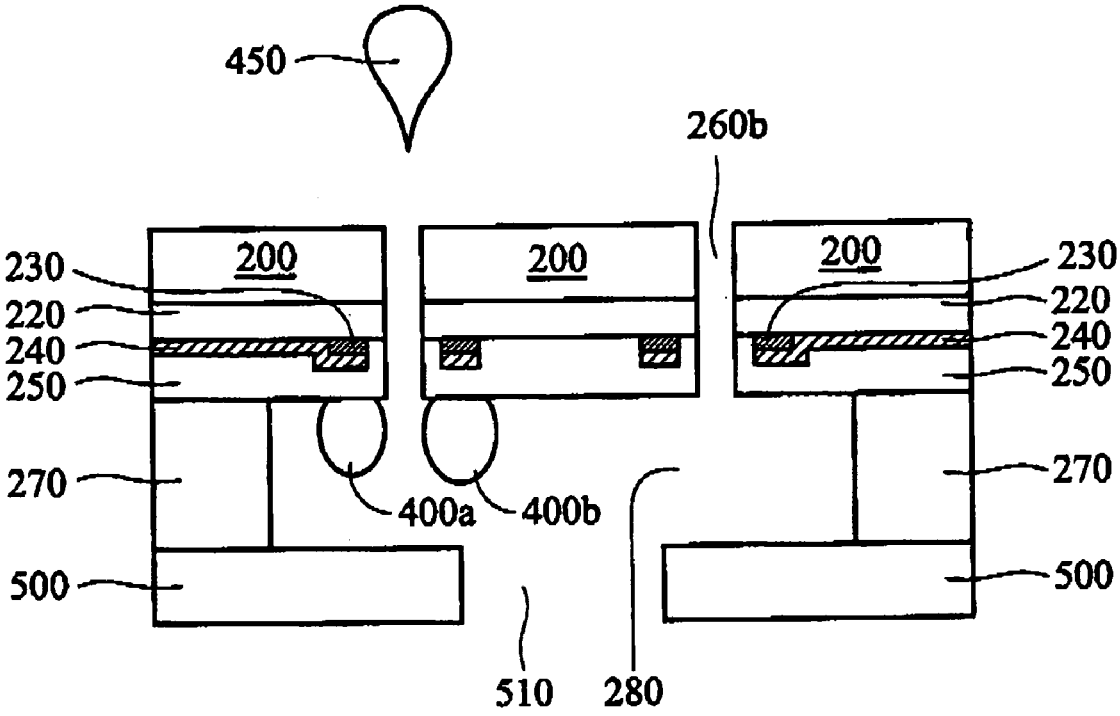
FIG. 7 shows a cross-section of a fluid injection micro device according to the present invention.

FIG. 7 shows a cross-section of a fluid injection micro device according to the present invention. Referring to FIG. 7, a completed fluid injection micro device may now be described. A completed fluid injection micro device comprises a substrate 200 (e.g., a silicon wafer). An insulating layer 220 is formed on the substrate 200. The insulating layer 220 comprises a silicon nitride layer with a thickness between about 1500 Å to 2000 Å. At least one heater 230 is formed on insulating layer 220. A patterned conductive layer 240 is formed overlying the heater 230 and the insulating layer 220 as a signal transmitting element. A protective layer 250 is formed overlying the conductive layer 240 and the insulating layer 220 and insulates the conductive layer 240. A patterned thick film 270 is formed on the protective layer 250, wherein a fluid chamber 280 is defined. A flexible circuit board 500 having an opening 510 connecting the fluid chamber 280 is bonded onto the patterned thick film 270, thereby transmitting an electrical signal. A nozzle 260*b* is located within the substrate 200 and acts as a micro fluid injection nozzle 260*b*.

The advantage of the present invention is the fabrication method of a fluid injection micro device using a deep silicon etching and polishing process. The nozzle is directly formed in the silicon substrate using lithographical etching, thereby increasing the accuracy of the nozzle and reducing the diameter of the micro fluid droplet.

Additionally, because the heating elements are located on the fluid chamber, it is possible to exert a dual-bubble mechanism, thereby providing improved orifice accuracy, reducing droplet diameter, minimizing cross talk and its related effects, and increasing the resolution of the print image.

What is claimed is:

1. A method for fabricating a fluid injection micro device, comprising the steps of:

providing a substrate;

forming at least one heater on the substrate;

forming a patterned conductive layer overlying the heater and the substrate;

forming a protective layer overlying the conductive layer and the substrate to insulate the conductive layer;

etching the protective layer and the substrate sequentially to form an opening;

forming a patterned thick film on the protective layer, thereby defining a fluid chamber; and removing part of the bottom of the substrate and thinning the substrate until the opening penetrates the substrate as a nozzle.

2. The method as claimed in claim 1, further comprising a step of forming an insulating layer between the substrate and the heater.

3. The method as claimed in claim 1, wherein the step of etching the opening is performed by an etching method including plasma etching, chemical dry etching, reactive ion etching, or laser etching.

4. The method as claimed in claim 1, wherein material of the thick film is photosensitive polymer.

5. The method as claimed in claim 4, wherein the photosensitive polymer is selected from the group consisting of epoxy resin, glycidyl methacrylate, acrylic resin, acrylate or methacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, and polyoxadiazole.

6. The method as claimed in claim 1, wherein the step of removing the bottom of the substrate is performed by etching, polishing, or chemical mechanical polishing (CMP).

7. The method as claimed in claim 1, further comprising a step of bonding the substrate onto a flexible circuit board.

8. The method as claimed in claim 7, wherein the flexible circuit board includes an opening connecting to the fluid chamber.

9. The method as claimed in claim 7, wherein the step of bonding is performed by a tape carrier package (TCP), or a chip on film (COF) package.

10. A method for fabricating a fluid injection micro device, comprising the steps of:

providing a substrate;

forming at least one heater on the substrate;

forming a patterned conductive layer overlying the heater and the substrate;

forming a protective layer overlying the conductive layer and the substrate to insulate the conductive layer;

removing part of the bottom of the substrate and thinning the substrate;

etching the protective layer and the substrate sequentially to form an opening through the substrate; and forming a patterned thick film on the protective layer, thereby defining a fluid chamber.

11. The method as claimed in claim 10, further comprising a step of forming an insulating layer between the substrate and the heater.

12. The method as claimed in claim 10, wherein the step of forming a patterned thick film precedes the step of forming an opening through the substrate.

13. The method as claimed in claim 10, wherein the step of removing the bottom of the substrate is performed by etching, polishing, or chemical mechanical polishing (CMP).

14. The method as claimed in claim 10, wherein the step of etching the opening is performed by plasma etching, chemical dry etching, reactive ion etching, or laser etching.

15. The method as claimed in claim 10, wherein material of the thick film is photosensitive polymer.

16. The method as claimed in claim 15, wherein the photosensitive polymer is selected from the group consisting of epoxy resin, glycidyl methacrylate, acrylic resin, acrylate or methacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, and polyoxadiazole.

17. The method as claimed in claim 10, further comprising a step of bonding the substrate onto a flexible circuit board.

18. The method as claimed in claim 17, wherein the flexible circuit board includes an opening connecting to the fluid chamber.

19. The method as claimed in claim 17, wherein the step of bonding is performed by a tape carrier package (TCP), or a chip on film (COF) package.

* * * * *